US005421736A

United States Patent [19]

Imanishi et al.

[11] Patent Number: 5,421,736

[45] Date of Patent: Jun. 6, 1995

[54] CONSTRUCTION FOR RETAINING COILED SPRING OF HIGH-VOLTAGE TERMINAL IN ENGINE IGNITION SYSTEM

[75] Inventors: Hisao Imanishi; Keiichi Nakajima; Tadashi Fujita, all of Yokkaichi, Japan

[73] Assignee: Sumitomo Wiring Systems, Ltd., Yokkaichi, Japan

[21] Appl. No.: 226,084

[22] Filed: Apr. 11, 1994

[30] Foreign Application Priority Data

Apr. 23, 1993 [JP] Japan ..... 5-021426 U

[51] Int. Cl.[6] ..... H01R 13/434; H01R 4/48

[52] U.S. Cl. ..... 439/125; 439/127; 439/893

[58] Field of Search ..... 439/125, 127–130, 439/843, 846, 893; 123/169 PA, 169 PH

[56] References Cited

U.S. PATENT DOCUMENTS 1,933,304 10/1933 Bell .
5,332,394 7/1994 Frost ..... 439/125
5,340,323 8/1994 Imanishi et al. ..... 439/125

FOREIGN PATENT DOCUMENTS 2-33473 2/1990 Japan .
3-47475 2/1991 Japan .
3105072 5/1991 Japan .
5-52175 3/1993 Japan .

OTHER PUBLICATIONS

English Language Abstract of JP'-47475.
English Language Abstract of JP 5-52175.
English Language Abstract of JP 2-33473.
English Language Abstract of JP 3-105072.

*Primary Examiner*—Eugene F. Desmond
*Attorney, Agent, or Firm*—Sandler, Greenblum & Bernstein

[57] ABSTRACT

A construction for retaining an electrically conductive coiled spring which is inserted into a hollow of a high-voltage terminal subjected to a high voltage in an engine ignition system so as to electrically connect a head terminal of a spark plug or an ignition coil and the high-voltage terminal, the construction comprising: a first stopper which is formed on a side wall of the hollow of the high-voltage terminal so as to project into the hollow and is brought into contact with an insertion end of the coiled spring so as to retain the insertion end of the coiled spring; and a second stopper which is radially fitted around an outer surface of the side wall of the high-voltage terminal and is formed with a tongue piece and a projection; wherein the tongue piece is inserted between neighboring coil windings of the coiled spring in the hollow from a slit of the high-voltage terminal, while the projection is brought into engagement with a hole of the high-voltage terminal so as to be inserted between further neighboring coil windings of the coiled spring in the hollow.

1 Claim, 3 Drawing Sheets

CONSTRUCTION FOR RETAINING COILED SPRING OF HIGH-VOLTAGE TERMINAL IN ENGINE IGNITION SYSTEM

BACKGROUND OF THE INVENTION

The present invention generally relates to a high-voltage terminal in an engine ignition system, which is directly connected with a spark plug or an ignition coil of an engine and more particularly, to a construction for retaining a coiled spring inserted into the high-voltage terminal.

FIG. 1 shows a known ignition system disclosed in Japanese Patent Laid-Open Publication No. 3-47475 (1991). In FIG. 1, a high-voltage terminal 2 is embedded in a high-voltage tower 1 and an electrically conductive coiled spring 5 for electrically connecting the high-voltage terminal 2 and a head terminal 4 of a spark plug 3 is inserted into a hollow of the high-voltage terminal 2. An insertion end 5*a* of the coiled spring 5 should be fixed to the high-voltage terminal 2 so as to prevent dropping by gravity of the coiled spring 5. To this end, an annular groove 2a is formed on a side wall of the hollow of the high-voltage terminal 2 and an outside diameter d1 of the insertion end 5*a* of the coiled spring 5 is so set as to be larger than an outside diameter d2 of the coiled spring 5, i.e. d1>d2 as shown in detail in FIG. 2. Thus, while the insertion end 5*a* is being radially compressed by rotating the coiled spring 5 in its winding direction, the coiled spring 5 is inserted into the hollow of the high-voltage terminal 2 such that the insertion end 5*a* is brought into engagement with the groove 2*a*.

However, the known engine ignition system has such a drawback that since it is difficult to insert the large-diameter insertion end 5*a* of the coiled spring 5 into the hollow of the high-voltage terminal 2, efficiency for inserting the coiled spring 5 into the hollow of the high-voltage terminal 2 is poor. Furthermore, the known engine ignition system is disadvantageous in that since the force of engagement of the coiled spring 5 with the groove 2*a*, namely, the force for fixing the coiled spring 5 to the groove 2*a* of the high-voltage terminal 2 is small, the coiled spring 5 is readily disengaged from the groove 2*a* when pulled outwardly.

SUMMARY OF THE INVENTION

Accordingly, an essential object of the present invention is to provide a construction for retaining a coiled spring of a high-voltage terminal in an engine ignition system, in which the coiled spring can be easily inserted into a hollow of the high-voltage terminal so as to be brought into engagement with the high-voltage terminal and the coiled spring can be fixedly retained in the hollow of the high-voltage terminal so as not to be disengaged from the hollow of the high-voltage terminal.

In order to accomplish this object of the present invention, a construction for retaining an electrically conductive coiled spring which is inserted into a hollow of a high-voltage terminal subjected to a high voltage in an engine ignition system so as to electrically connect a head terminal of a spark plug or an ignition coil and the high-voltage terminal, according to the present invention comprises: a first stopper which is formed on a side wall of the hollow of the high-voltage terminal so as to project into the hollow and is brought into contact with an insertion end of the coiled spring so as to retain the insertion end of the coiled spring; the high-voltage terminal being formed, at locations between the first stopper and a mouth of the hollow on the side wall, with a slit and a hole; and a second stopper which radially fits around an outer surface of the side wall of the high-voltage terminal and is formed with a tongue piece and a projection; wherein the tongue piece is inserted between neighboring coil windings of the coiled spring in the hollow from the slit, while the projection is brought into engagement with the hole so as to be inserted between further neighboring coil windings of the coiled spring in the hollow.

In the construction for retaining the coiled spring, according to the present invention, when the insertion end of the coiled spring is inserted into the hollow of the high-voltage terminal, the insertion end of the coiled spring is brought into contact with the first stopper so as to be retained by the first stopper. During this insertion of the coiled spring into the hollow, since it is not necessary to radially compress the insertion end by rotating the coiled spring in its winding direction, the coiled spring can be inserted into the hollow smoothly.

Subsequently, when the second stopper fits around the outer surface of the side wall of the hollow of the high-voltage terminal so as to fit the tongue piece of the second stopper into the hollow from the slit of the high-voltage terminal, the tongue piece is inserted between neighboring coil windings of the coiled spring so as to retain the coiled spring. Therefore, even if the coiled spring is pulled outwardly from the high-voltage terminal, the coiled spring is securely retained by the tongue piece so as not to be disengaged from the hollow.

Meanwhile, the projection of the second stopper is brought into engagement with the holes of the high-voltage terminal so as to positively fix the second stopper to the high-voltage terminal and is inserted between neighboring coil windings of the coiled spring in the hollow. Therefore, even in the case where the coiled spring is not retained by the tongue piece for some reason or other, the coiled spring is retained by the projection so as not to be disengaged from the hollow.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
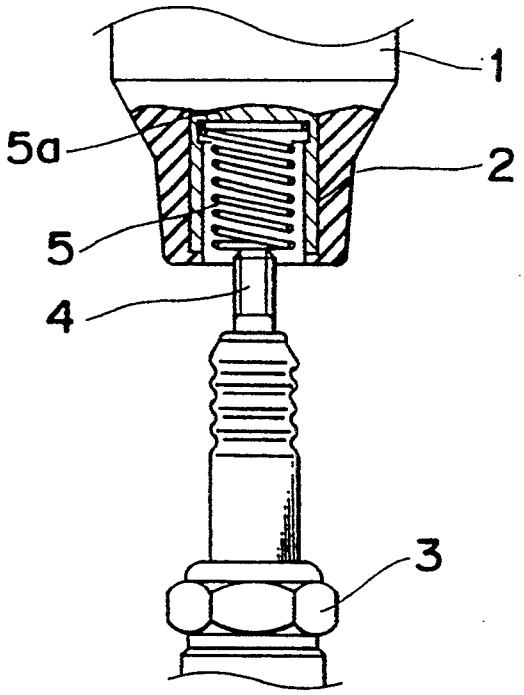
Fig. 1 PRIOR ART
FIG. 1 is a partially sectional side elevational view of a prior art engine ignition system (already referred to)
Figure 2:
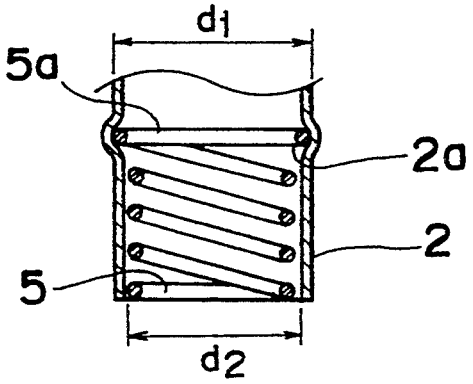
Fig. 2 PRIOR ART
FIG. 2 is a fragmentary sectional view of the prior art engine ignition system of FIG. 1 (already referred to)
Figure 3:
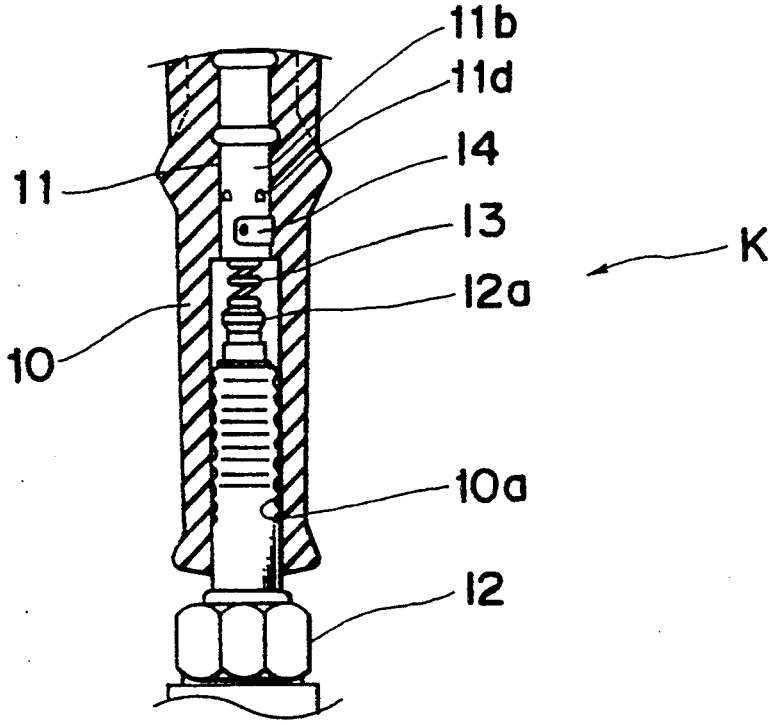
FIG. 3 is a side elevational view of an engine ignition system according to the present invention.

Referring now to the drawings, there is shown in FIG. 3, an engine ignition system K according to one embodiment of the present invention. A cylindrical high-voltage terminal 11 made of electrically conductive material is inserted into a high-voltage tower 10 made of insulating resin. A hole 10*a* for receiving a head terminal 12*a* of a spark plug 12 is formed at a lower portion of the high-voltage tower 10.

Figure 4:
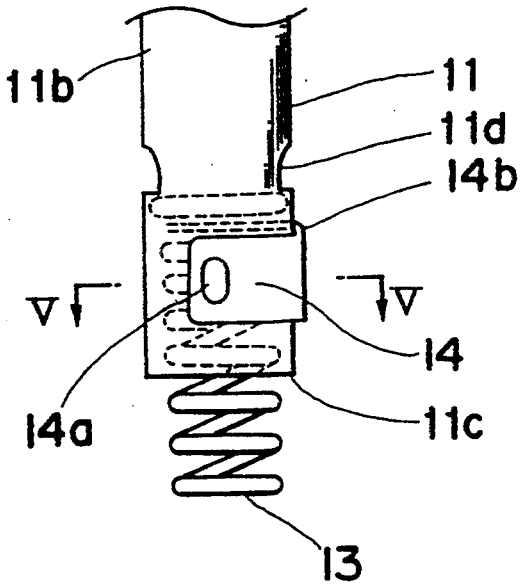
FIG. 4 is an enlarged fragmentary view of the engine ignition system of FIG. 3.
Figure 5:
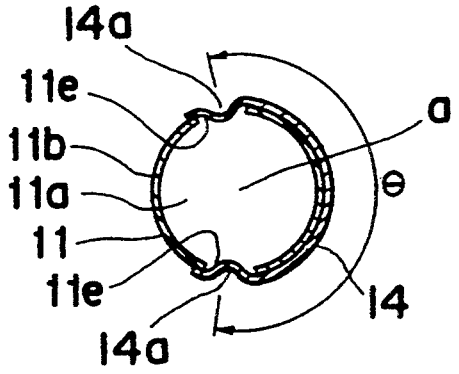
FIG. 5 is a sectional view taken along the line V—V in FIG. 4.
Figure 6:
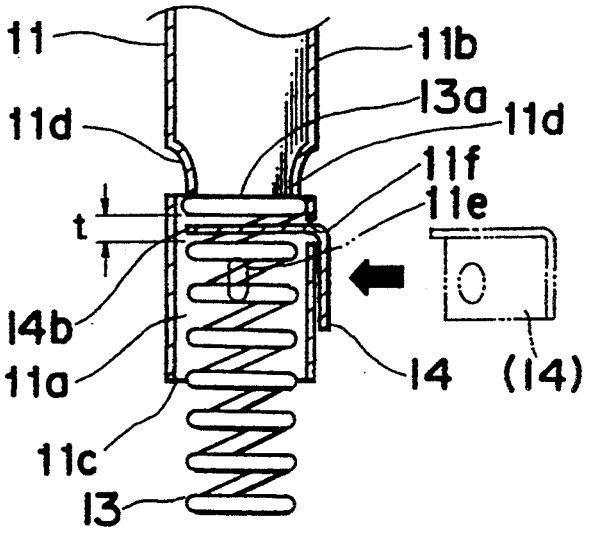
FIG. 6 is a sectional view of a high-voltage terminal employed in the engine ignition system of FIG. 3.

As shown in FIGS. 4 to 6, the high-voltage terminal 11 has a circular hollow 11a into which a coiled spring 13 for electrically connecting the head terminal 12*a* of the spark plug 12 and the high-voltage terminal 11 is inserted. At an axial location spaced an identical distance from a mouth 11*c* of the hollow 11*a*, at least two first stoppers 11*d* are formed on a side wall 11*b* of the hollow 11*a* so as to radially project into the hollow 11*a*.

Meanwhile, at an axial location disposed between the mouth 11*c* and the first stoppers 11*d*, two circular holes 11*e* are formed on the side wall 11*b* of the hollow 11*a*. Furthermore, at an axial location disposed between the first stoppers 11*d* and the holes 11*e*, a slit 11*f* is formed on the side wall 11*b* of the hollow 11*a*.

As shown in FIG. 5, the holes 11*e* are circumferentially spaced an angle $\theta$ ($\geqq 180°$) from each other about an axis a of the hollow 11*a*, while the slit 11*f* is disposed at a circumferentially central position of the angle $\theta$.

Figure 7:
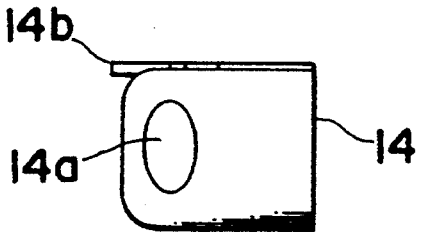
FIG. 7 is a side elevational view of a second stopper employed in the engine ignition system of FIG. 3.
Figure 8:
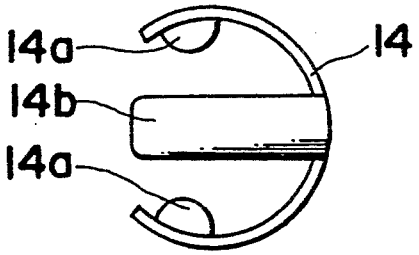
FIG. 8 is a top plan view of the second stopper of FIG. 7.

On the other hand, as shown in FIGS. 7 and 8, the engine ignition system K further includes a substantially annular second stopper 14 made of elastic material. The second stopper 14 is radially fitted around an outer surface of the side wall 11*b* of the hollow 11*a*. Two radially inwardly extending projections 14*a* are formed on the second stopper 14 so as to be, respectively, brought into engagement with the holes 11*e* of the side wall 11*b* of the hollow 11*a*. The projections 14*a* have such a height as to radially inwardly extend into the hollow 11*a* when the projections 14*a* have been brought into engagement with the holes 11*e*, respectively.

Meanwhile, a rectangular tongue piece 14*b* is formed on the second stopper 14 so as to be inserted deeply into the hollow 11*a* from the slit 11*f* of the side wall 11*b*.

By the above described arrangement of the high-voltage terminal 11, the coiled spring 13 is inserted into the high-voltage terminal 11 so as to be fixed to the high-voltage terminal 11 as follows. When an insertion end 13*a* of the coiled spring 13 is inserted into the hollow 11*a* of the high-voltage terminal 11 from the mouth 11*c*, the insertion end 13*a* is brought into contact with the first stoppers 11*d* so as to be retained by the first stoppers 11*d*. During this insertion of the coiled spring 13 into the hollow 11*a* of the high-voltage terminal 11, since the second stopper 14 is not attached to the high-voltage terminal 11, the coiled spring 13 can be smoothly inserted into the hollow 11*a* of the high-voltage terminal 11. Meanwhile, in contrast with conventional high-voltage terminals, it is not necessary to radially compress the insertion end 13*a* by rotating the coiled spring 13 in its winding direction.

In this state, by depressing opposite circumferential ends of the second stopper 14 radially outwardly, the second stopper 14 is fitted around the outer surface of the side wall 11*b* of the hollow 11*a* of the high-voltage terminal 11 symmetrically with respect to the axis a of the hollow 11*a*. Thus, the tongue piece 14*b* of the second stopper 14 is fitted into the hollow 11*a* from the slit 11*f* of the side wall 11*b* of the hollow 11*a* and is inserted between neighboring coil windings of a pitch t (FIG. 6) of the coiled spring 13 in the hollow 11*a* so as to retain the coiled spring 13. As a result, the coiled spring 13 is securely retained by the tongue piece 14*b*. Therefore, even if the coiled spring 13 is pulled outwardly from the high-voltage terminal 11, the coiled spring 13 is not disengaged from the hollow 11*a* of the high-voltage terminal 11.

Meanwhile, the projections 14*a* of the second stopper 14 are, respectively, brought into engagement with the holes 11*e* of the side wall 11*b* of the high-voltage terminal 11 so as to elastically secure the second stopper 14 to the high-voltage terminal 11 positively. At the same time, the projections 14*a* project from the side wall 11*b* into the hollow 11*a* so as to be inserted between neighboring coil windings of the coiled spring 13 at a location disposed below the tongue piece 14*b* through one or two coil windings of the coiled spring 13. Accordingly, even in case the coiled spring 13 is not retained by the tongue piece 14*b* for some reason or other, the coiled spring 13 is retained in the hollow 11*a* by the projections 14*a* so as not to be disengaged from the hollow 11*a*.

As is clear from the foregoing description of the construction for retaining the coiled spring of the high-voltage terminal of the present invention, since there is no obstacle in the hollow of the high-voltage terminal at the time of insertion of the coiled spring into the hollow, the coiled spring can be inserted into the hollow quite smoothly.

Meanwhile, when the second stopper has been fitted around the outer surface of the side wall of the high-voltage terminal, the tongue piece is inserted between neighboring coil windings of the coiled spring in the hollow from the slit of the high-voltage terminal so as to retain the coiled spring. Therefore, even if the coiled spring is pulled outwardly from the high-voltage terminal, the coiled spring is securely retained in the hollow by the tongue piece so as not to be disengaged from the hollow.

Furthermore, the projections of the second stopper are brought into engagement with the holes of the high-voltage terminal so as to positively fix the second stopper to the high-voltage terminal and are inserted between neighboring coil windings of the coiled spring in the hollow of the high-voltage terminal. Therefore, even if the coiled spring is not retained by the tongue piece for some reason or other, the coiled spring is securely retained in the hollow by the projections so as not be disengaged from the hollow of the high-voltage terminal.

What is claimed is:

1. A construction for retaining an electrically conductive coiled spring which is inserted into a hollow of a high-voltage terminal subjected to a high voltage in an engine ignition system so as to electrically connect a head terminal of a spark plug or an ignition coil and the high-voltage terminal, the construction comprising:

a first stopper which is formed on a side wall of the hollow of the high-voltage terminal so as to project into the hollow and is brought into contact with an insertion end of the coiled spring so as to retain the insertion end of the coiled spring;

the high-voltage terminal being formed, at locations between the first stopper and a mouth of the hollow on the side wall, with a slit and a hole; and a second stopper which radially fits around an outer surface of the side wall of the high-voltage terminal and is formed with a tongue piece and a projection;

wherein the tongue piece is inserted between neighboring coil windings of the coiled spring in the hollow from the slit, while the projection is brought into engagement with the hole so as to be inserted between further neighboring coil windings of the coiled spring in the hollow.

* * * * *